US011229831B2

(12) United States Patent
Bombard et al.

(10) Patent No.: US 11,229,831 B2
(45) Date of Patent: Jan. 25, 2022

(54) TELEMARK SKI BINDING ASSEMBLY

(71) Applicant: Bishop Bindings LLC, Edwards, CO (US)

(72) Inventors: David Bombard, Edwards, CO (US); Erik M. Warmenhoven, Avon, CO (US); Merlin Peter Van Dyke, Edwards, CO (US)

( * ) Notice: Subject to any disclaimer, the term of this patent is extended or adjusted under 35 U.S.C. 154(b) by 0 days.

(21) Appl. No.: 16/449,911

(22) Filed: Jun. 24, 2019

(65) Prior Publication Data

US 2019/0388770 A1 Dec. 26, 2019

Related U.S. Application Data

(60) Provisional application No. 62/689,213, filed on Jun. 24, 2018.

(51) Int. Cl.
*A63C 9/22* (2012.01)
*A63C 9/20* (2012.01)

(52) U.S. Cl.
CPC . *A63C 9/22* (2013.01); *A63C 9/20* (2013.01)

(58) Field of Classification Search
CPC .... A63C 9/00; A63C 9/20; A63C 9/22; A63C 2201/06; A63C 2009/008
See application file for complete search history.

(56) References Cited

U.S. PATENT DOCUMENTS 4,174,122 A 11/1979 Gorlach
4,558,884 A 12/1985 Guitel et al.
4,887,833 A 12/1989 Bailey
5,333,892 A 8/1994 Stritzl et al.
5,558,353 A 9/1996 Arduin et al.
5,794,962 A 8/1998 Bardin et al.
5,924,719 A * 7/1999 Girard ..... A63C 9/20 280/615
6,431,578 B2 8/2002 Pedersen et al.
6,986,526 B2 1/2006 Haughlin
7,210,698 B2 5/2007 Dandurand
7,246,812 B1 7/2007 Ayliffe
(Continued)

OTHER PUBLICATIONS

USPTO AA dated Feb. 28, 2018 in connection with U.S. Appl. No. 14/699,330.

(Continued)

*Primary Examiner* — Brian L Swenson
(74) *Attorney, Agent, or Firm* — James Conte; Conte Law Group

(57) ABSTRACT

A telemark ski binding has a toe retainer pivotally coupled to a base. A lock assembly of the binding has an actuator assembly. The lock assembly is adjustable between a locked configuration and an unlocked configuration. The binding further has a heel retainer rotatably coupled to the toe retainer. When the lock assembly is in the unlocked configuration, the toe retainer is unlocked, and the toe retainer and heel retainer are both rotatable together substantially inline, relative to the base, around a first center point. When the lock assembly is in the locked configuration, the toe retainer is locked, and the toe retainer is restrained from rotating relative to the base. The heal retainer is rotatable relative to the toe retainer around a second center point. The second center point is at a different location from said first center point.

13 Claims, 8 Drawing Sheets

(56) References Cited

U.S. PATENT DOCUMENTS

| | | | | |
|---|---|---|---|---|
| 7,264,263 | B2 | 9/2007 | Riedel et al. | |
| 7,401,802 | B2 | 7/2008 | Walker et al. | |
| 7,451,997 | B2 | 11/2008 | Hauglin | |
| 7,458,598 | B2 | 12/2008 | Giffin et al. | |
| 7,556,280 | B2 | 7/2009 | Holzer | |
| 7,681,905 | B2 | 3/2010 | Hauglin | |
| 7,735,851 | B2 | 6/2010 | Shute et al. | |
| 8,167,331 | B2 | 5/2012 | Wøllo et al. | |
| 8,328,225 | B2 | 12/2012 | Prigge et al. | |
| 8,534,697 | B2 | 9/2013 | Lengel | |
| 8,801,026 | B2 * | 8/2014 | Wollo | A63C 9/20 280/615 |
| 8,876,123 | B2 | 11/2014 | Bradshaw | |
| 9,016,713 | B2 | 4/2015 | Wøllo et al. | |
| 9,033,359 | B2 | 5/2015 | Favret et al. | |
| 9,452,343 | B2 | 9/2016 | Schröer et al. | |
| 9,526,972 | B2 | 12/2016 | Steinke et al. | |
| 9,566,498 | B2 | 2/2017 | Holm et al. | |
| 9,713,758 | B2 | 7/2017 | Lefsrud | |
| 9,795,862 | B2 | 10/2017 | Soldan et al. | |
| 10,058,763 | B2 | 8/2018 | Bombard et al. | |
| 2003/0168830 | A1 | 9/2003 | Haughlin | |
| 2003/0189315 | A1 | 10/2003 | Venable et al. | |
| 2006/0087102 | A1 | 4/2006 | Coles et al. | |
| 2007/0108738 | A1 * | 5/2007 | Walker | A63C 9/02 280/620 |
| 2012/0018981 | A1 * | 1/2012 | Lengel | A63C 9/0807 280/623 |
| 2014/0159345 | A1 * | 6/2014 | Indulti | A63C 9/086 280/614 |
| 2014/0284901 | A1 * | 9/2014 | Wollo | A63C 9/06 280/614 |
| 2016/0346664 | A1 * | 12/2016 | Mouyade | A63C 9/08592 |
| 2019/0381388 | A1 * | 12/2019 | Fellin | A63C 9/0807 |

OTHER PUBLICATIONS

USPTO FOA dated Oct. 31, 2017 in connection with U.S. Appl. No. 14/699,330.
USPTO NFOA dated Oct. 14, 2016 in connection with U.S. Appl. No. 14/699,330.
USPTO NOA dated May 21, 2018 in connection with U.S. Appl. No. 14/699,330.
USPTO NOA mailed Apr. 24, 2018 in connection with U.S. Appl. No. 14/699,330.
USPTO RR dated Apr. 7, 2016 in connection with U.S. Appl. No. 14/699,330.

* cited by examiner

TELEMARK SKI BINDING ASSEMBLY

CROSS REFERENCE TO RELATED APPLICATIONS

The present application claims benefit of domestic priority from provisional application 62/689,213, filed Jun. 24, 2018. The provisional application 62/689,213 is incorporated in its entirety herein by reference.

FIELD

The present disclosure concerns a telemark ski binding assembly having a locking assembly which locks a toe retainer. Locking the toe retainer prevents the toe retainer from pivoting relative to a base. When the toe retainer is locked, a knuckle, main tubes, rear case, and heel retainer can all rotate together in unison along a radius extending from a second center point which is a pivot point. When the toe retainer is unlocked the toe retainer, knuckle, main tubes, rear case, and heel retainer can all rotate together in unison along a radius extending from a first center point different from the second center point.

BACKGROUND

Telemark ski binding systems are well known.

U.S. Pat. No. 9,566,498 discloses a ski binding comprising a first recess for receiving a ski shoe pin, a locking member movable between a locking position and an open position, a biasing means to bias the locking member towards the locking position, and an activation member rotatably attached to the housing for rotation around a transversal rotational axis of the binding. The locking member has at least one outer portion that allows a ski shoe pin to force the locking member from the locking position towards the open position when the ski shoe pin enters the first recess. The activation member has an arm extending radially away from its transversal rotational axis. The activation member and the locking member are operatively connected such that when the arm rotates in the first rotational direction through a predetermined lower operational range, the activation member forces the locking member from the locking position to the open position.

U.S. Pat. No. 9,526,972 discloses a front unit for a ski binding, comprising a front jaw for fixating a ski boot in a downhill position and engagement members for pivotably supporting the ski boot about a horizontal pivot axis (S) perpendicular to a longitudinal axis of a ski in a climbing position, wherein the front jaw is disposed slidably in the direction of the longitudinal axis of the ski relative to the engagement members for switching between the downhill position and the climbing position, wherein the engagement members are each disposed on a first end of two opposing guiding arms which substantially extend in the direction of the longitudinal axis of the ski and each are guided by a front jaw member of the front jaw.

U.S. Pat. No. 7,246,812 discloses a ski binding of the cross-country type in which a ski boot's heel may be elevated with respect to the ski's top surface while in the act of skiing. The binding includes a toe piece associated with a heel retainer through a spring-biased linkage. A linkage typically includes a pre-loaded compression spring mounted external to a core element. A preferred linkage includes a plurality of rigid link elements defining a plurality of intermediate pivot axes between an anchor and the heel retainer. Certain preferred linkage systems permit unfettered boot flexion, but transversely maintain the heel retainer in a zone over the ski to facilitate step-in engagement. Desirably, the core is adjustable along the linkage, to change a spacing between the toe piece and heel retainer independent of spring pre-load. Preferred embodiments of the binding include a rear frame adapted to permit step-in engagement of a ski boot. Certain frames may carry a televator. A frame may function as a rear shim to permit adjusting a binding to fit boots of different sizes without necessitating adjustment of the position of a rear shim installed on a ski.

U.S. Pat. No. 8,328,225 discloses a ski binding adaptor for alpine ski touring and downhill, including a floating heel lock assembly and multifunctional rotatable locking arms. Ski bindings are mounted on an adaptor mounting plate, channel or beam assembly that pivots at the toe. The heel lock mechanism "floats" on a rail or rails to accommodate ski flex, and includes a multi-position climbing bar or heel riser. The floating heel block and locking mechanism are interconvertible for different ski modes: in fixed heel-mode—the locking arms act to firmly secure the heel to the ski for aggressive downhill conditions or riding style, and in free heel mode—the locking arms may be configured to support touring and climbing configurations. The ski binding adaptor with floating heel lock mechanism is optionally compatible with a range of alpine ski touring and downhill bindings.

SUMMARY

A telemark ski binding has a toe retainer pivotally coupled to a base. A lock assembly of the binding has an actuator assembly. The lock assembly is adjustable between a locked configuration and an unlocked configuration. The binding further has a heel retainer rotatably coupled to the toe retainer. When the lock assembly is in the unlocked configuration, the toe retainer is unlocked, and the toe retainer and heel retainer are both rotatable together in unison and substantially inline, relative to the base, around a first center point. When the lock assembly is in the locked configuration, the toe retainer is locked, and the toe retainer is restrained from rotating relative to the base. The heal retainer is rotatable relative to the toe retainer around a second center point. The second center point is at a different location from said first center point. Other features of the telemark ski binding assembly are described below and shown in the drawings.

Figure 1:
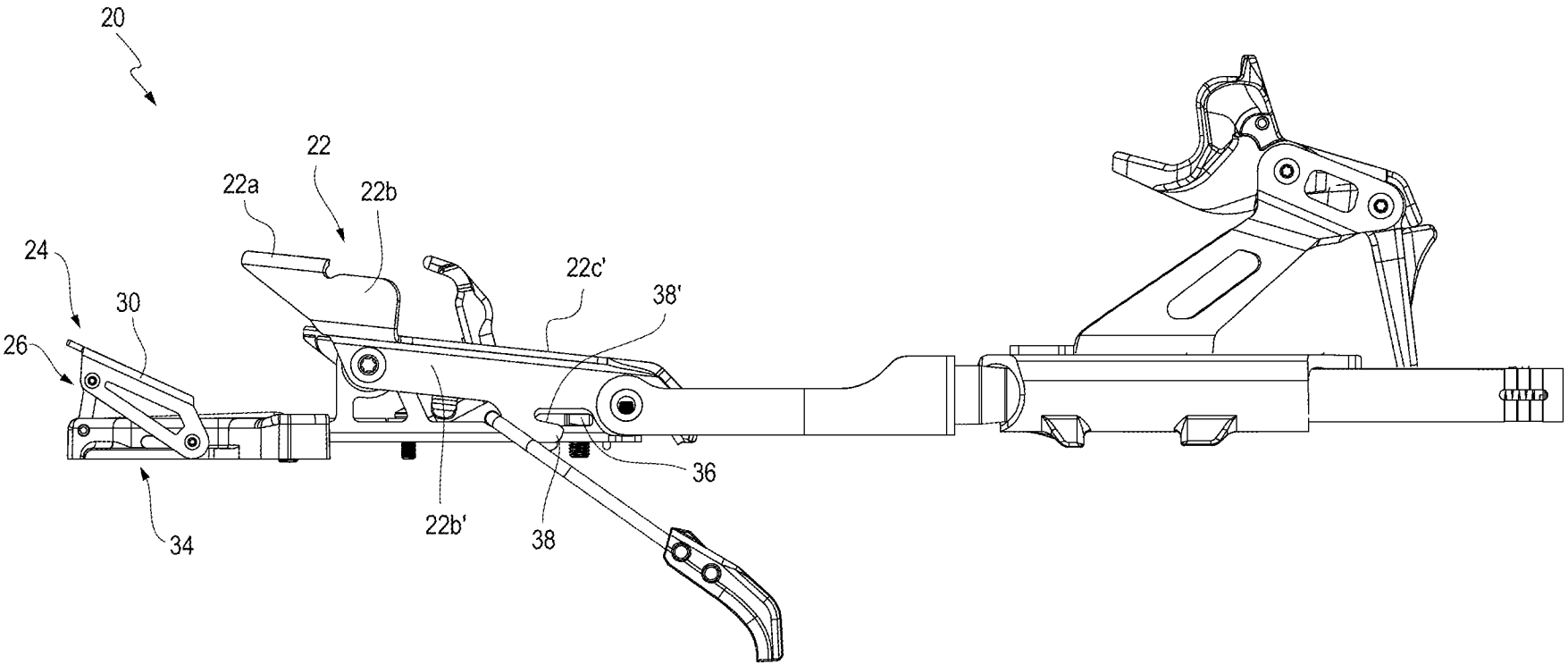
FIG. 1 is a side view of a telemark ski binding assembly of the present invention; a lock assembly of the ski binding assembly is in an unlocked configuration and a toe retainer of the ski binding assembly is unlocked; a ski brake of the assembly is in a braking position; and the heel clip and clip lock are in a position ready to receive a ski boot.

Before any embodiments of the invention are explained in detail, it is to be understood that the invention is not limited in its application to the details of construction and arrangement of components set forth in the following description or as illustrated in the drawings. The invention is capable of other embodiments and of being practiced or of being carried out in various ways. Also, it is to be understood that the phraseology and terminology used herein is for description and should not be regarded as limiting. The use of "including," "comprising" or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

DETAILED DESCRIPTION

Figure 2:
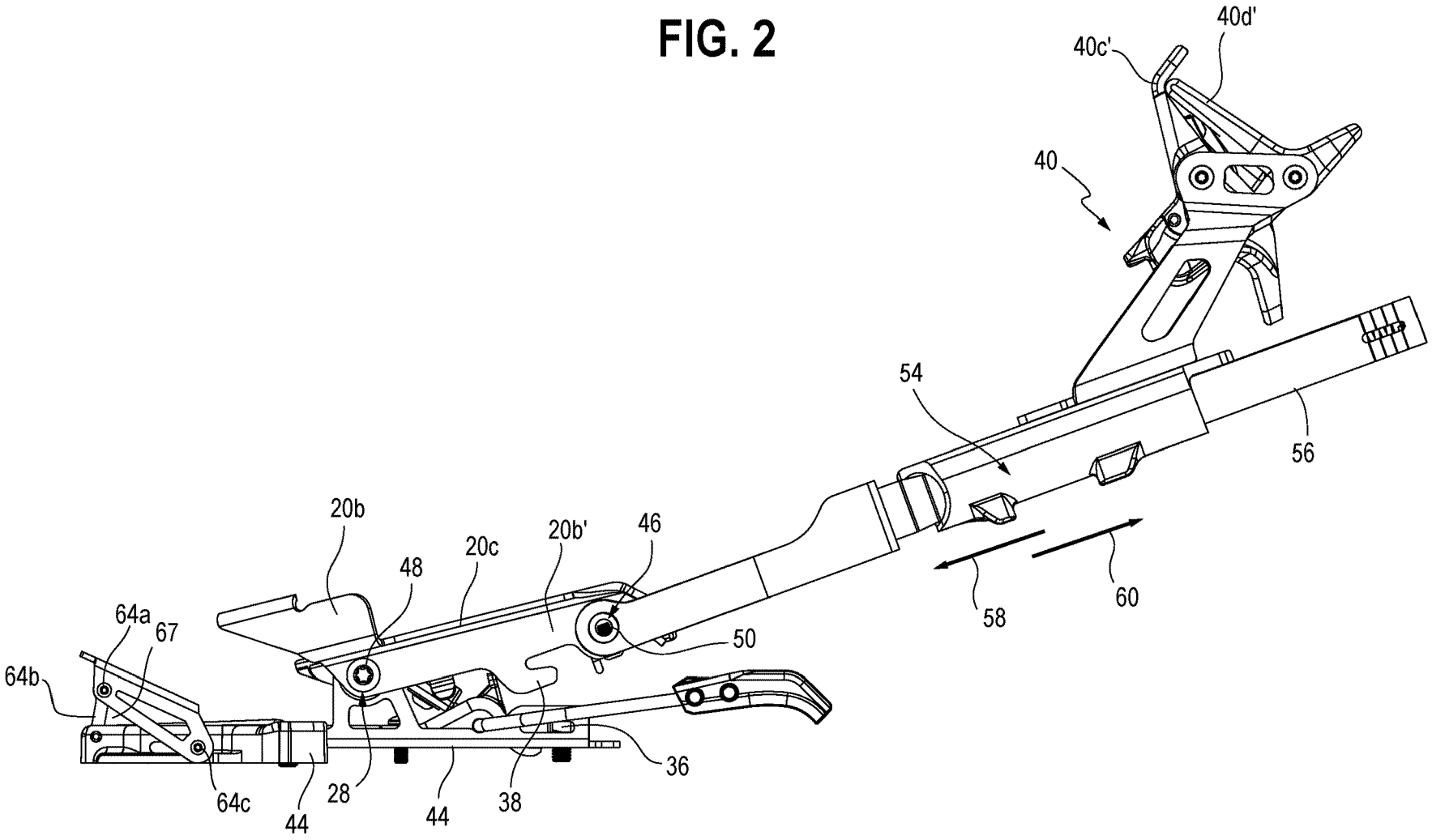
FIG. 2 is a side view of the telemark ski binding assembly of FIG. 1; the lock assembly of the ski binding assembly is in the unlocked configuration and the toe retainer of the ski binding assembly is unlocked, the ski brake of the assembly is in a skiing position, and the heel clip and clip lock are in a position showing there orientation as if a boot was in the binding assembly; the toe retainer, a knuckle, main tubes, rear case, and heel retainer have all been rotated together in unison and inline along and with a radius around a first center point relative to a base.
Figure 3:
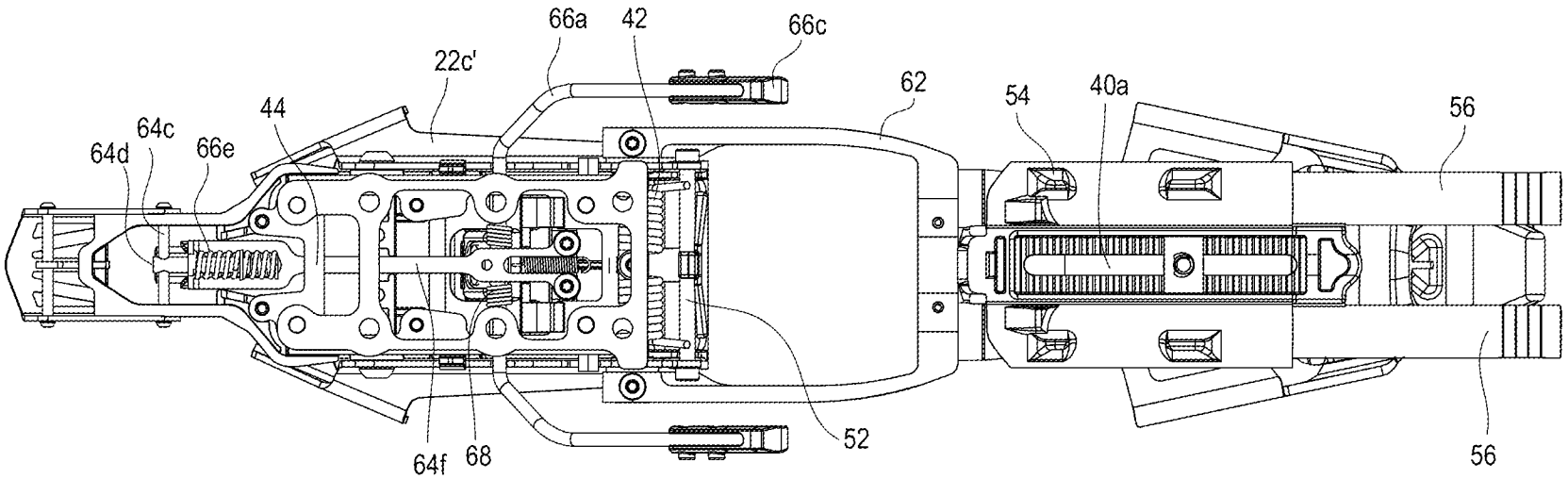
FIG. 3 is a bottom view of the telemark ski binding assembly of FIG. 1, the lock assembly of the ski binding assembly is in the unlocked configuration and the toe retainer of the ski binding assembly is unlocked; the ski brake of the assembly is in the braking position; and the heel clip and clip lock are in a position ready to receive a ski boot; none of the toe retainer, knuckle, main tubes, rear case, and heel retainer have been rotated relative to the base.
Figure 4:
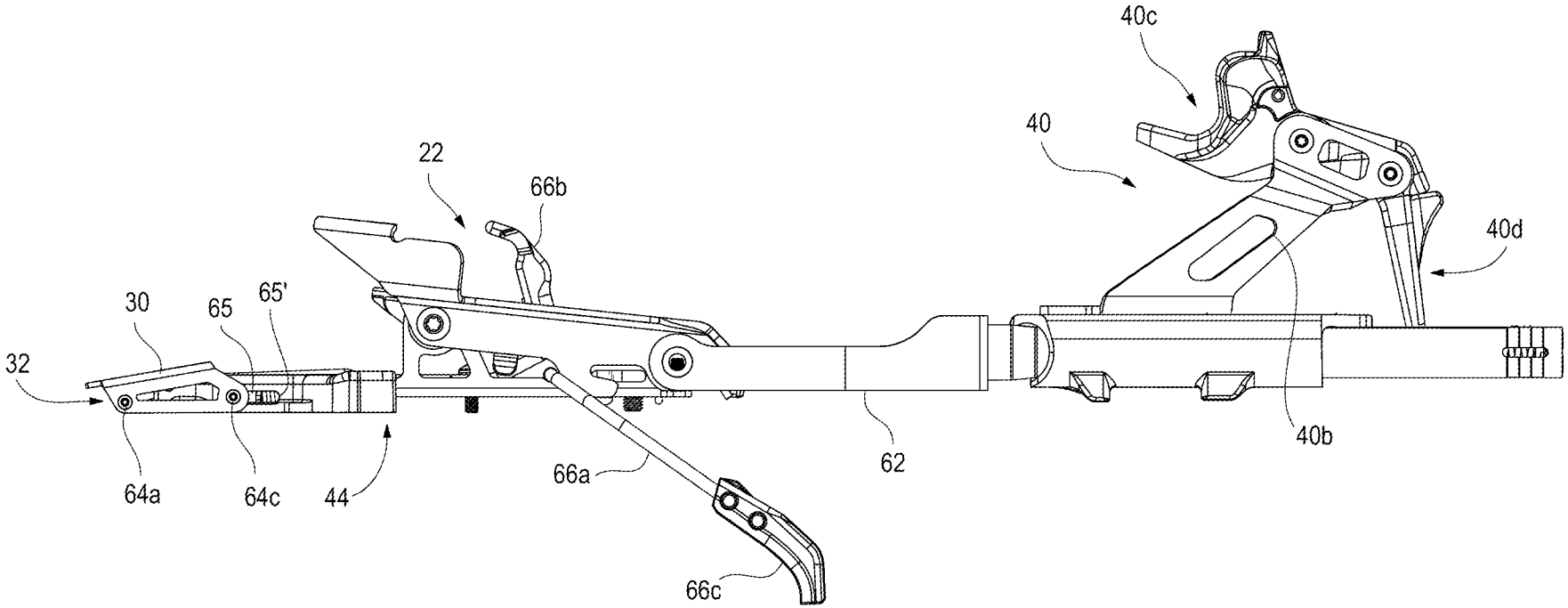
FIG. 4 is a side view of the telemark ski binding assembly of FIG. 1; the lock assembly of the ski binding assembly is in a locked configuration and the toe retainer of the ski binding assembly is locked; the ski brake of the assembly is in the braking position; and the heel clip and clip lock are in the position ready to receive a ski boot.
Figure 5:
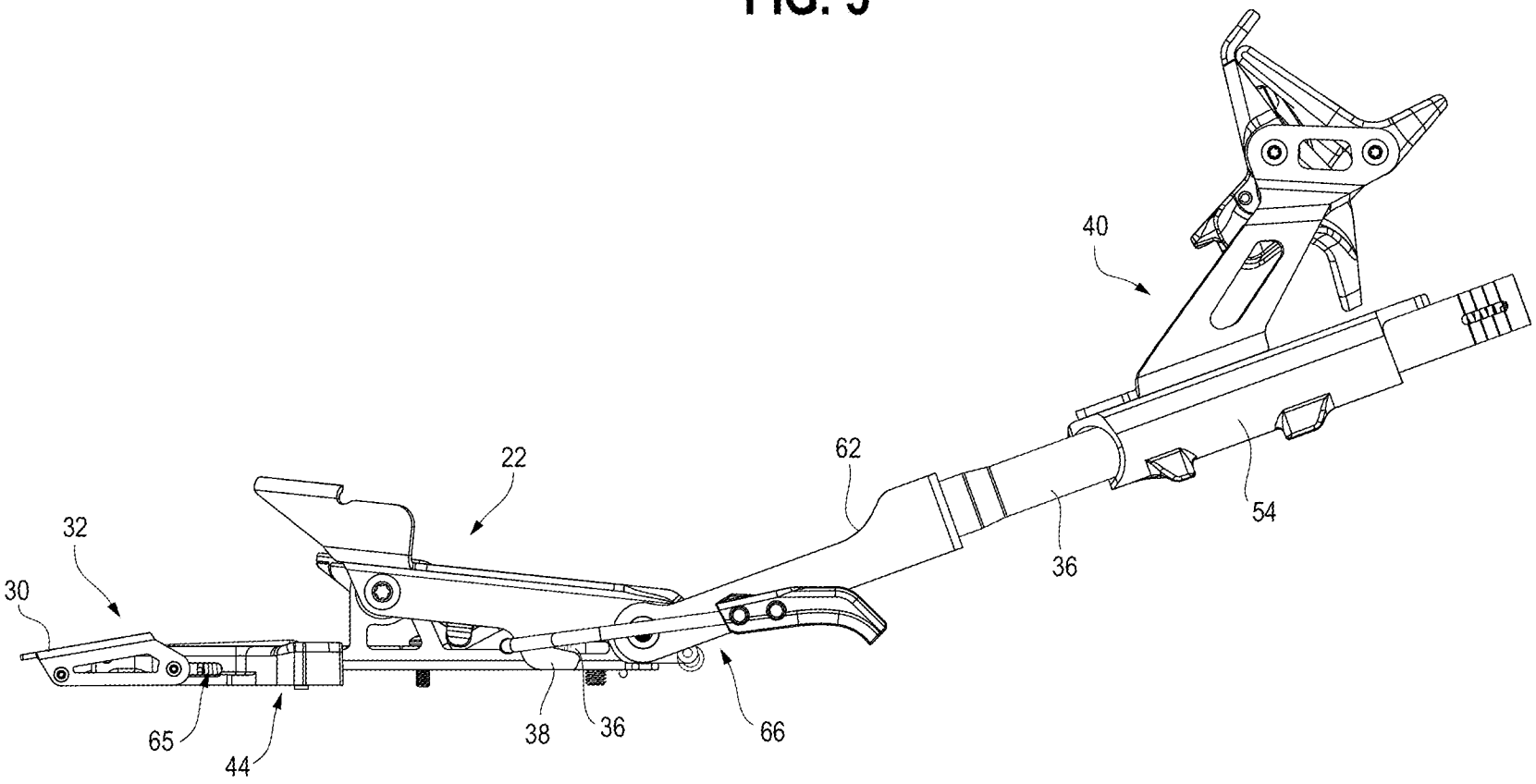
FIG. 5 is a side view of the telemark ski binding assembly of FIG. 4; the lock assembly of the ski binding assembly is in the locked configuration and the toe retainer of the ski binding assembly is locked, the ski brake of the assembly is in the skiing position, and the heel clip and clip lock are in the position showing there orientation as if a boot was in the binding; the knuckle, main tubes, rear case and heal retainer have all been rotated in unison and inline along and with a radius about a second center point relative to the toe retainer; the toe retainer is not rotated relative to the base.
Figure 6:
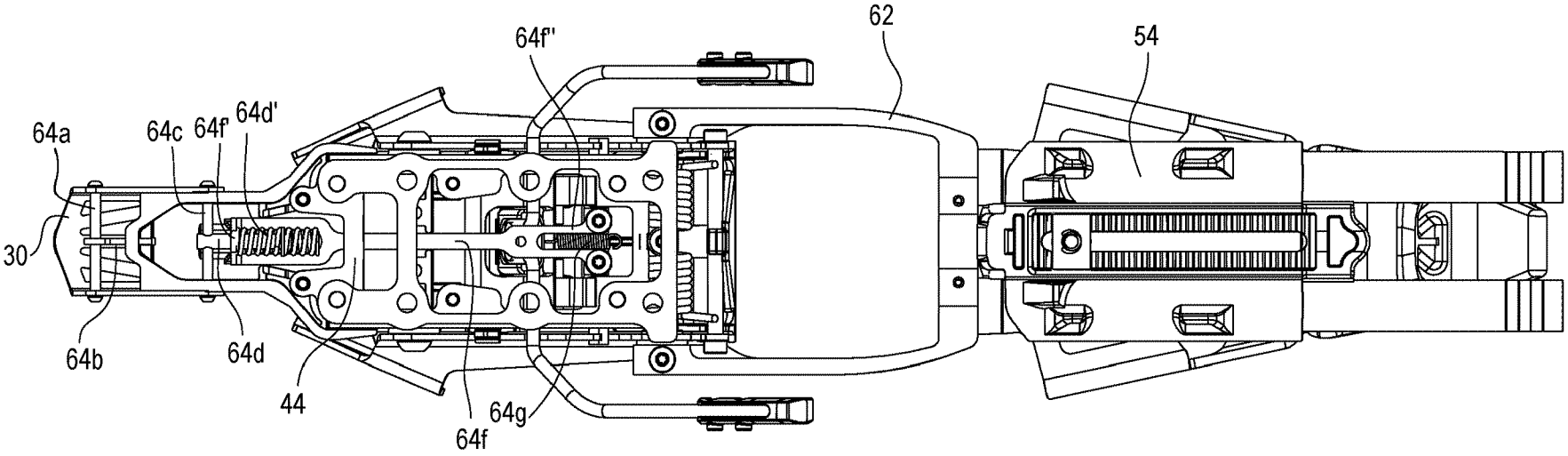
FIG. 6 is a bottom view of the telemark ski binding assembly of FIG. 4, the lock assembly of the ski binding assembly is in the locked configuration and the toe retainer of the ski binding assembly is locked; the ski brake of the assembly is in the braking position; and the heel clip and clip lock are in the position ready to receive the ski boot; none of the knuckle, main tubes, rear case, and heel retainer have been rotated relative to the toe retainer.
Figure 7:
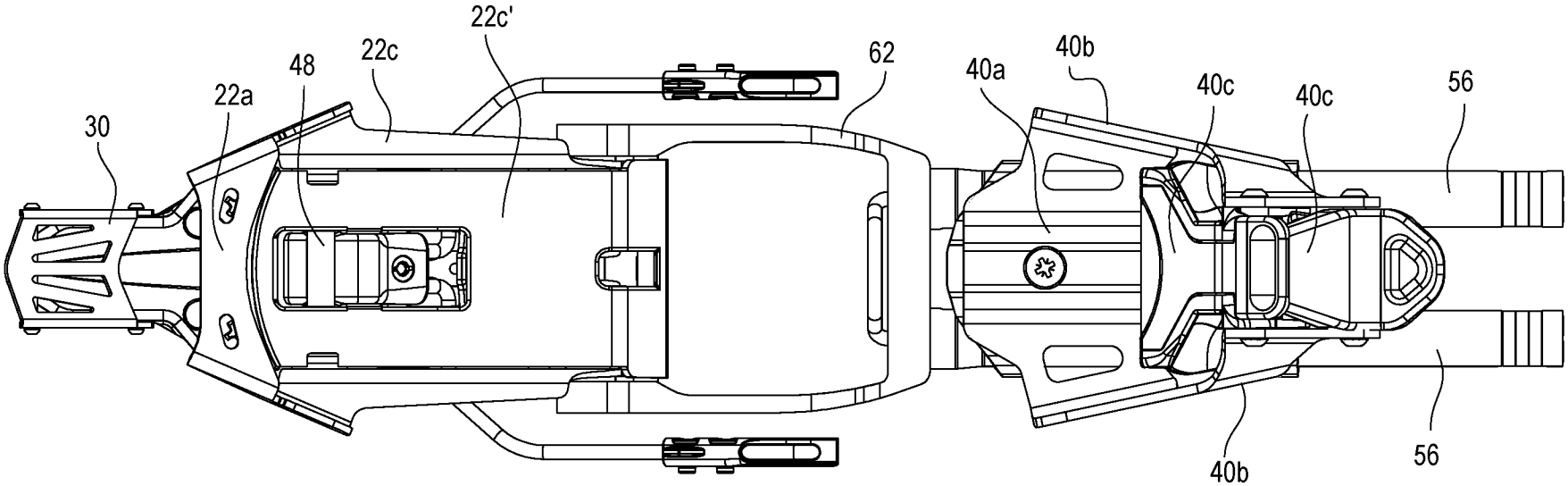
FIG. 7 is a top isometric view of the telemark ski binding assembly of FIG. 1.
Figure 8:
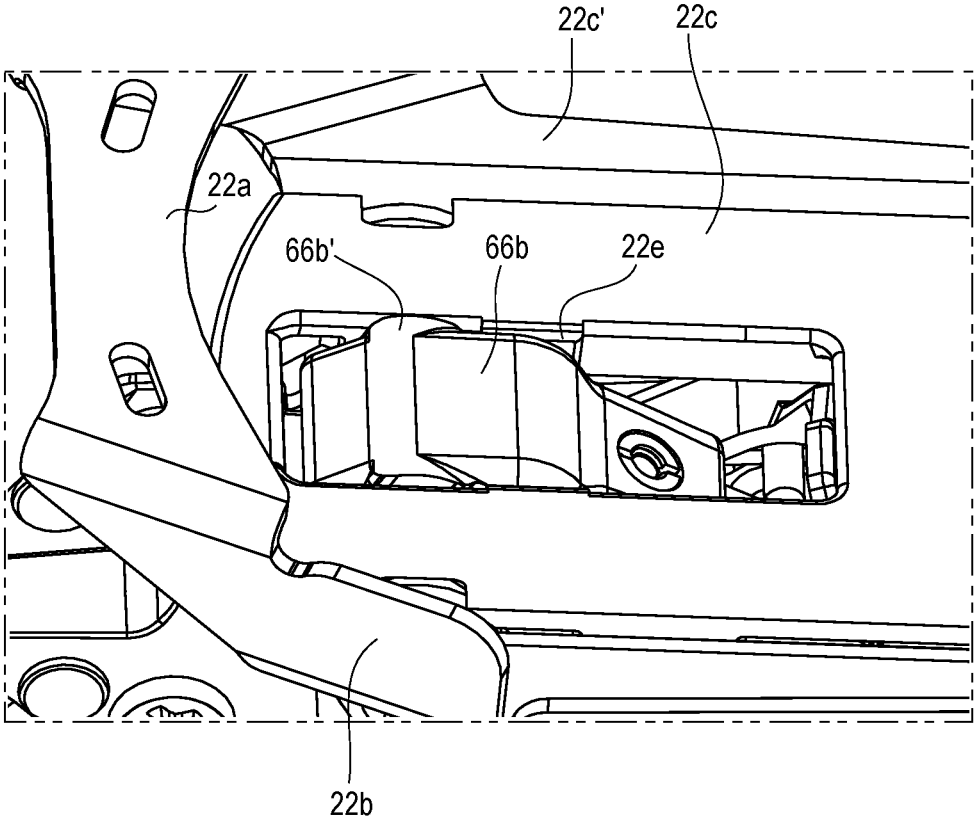
FIG. 8 is a closeup view of a brake mover and toe retainer of the telemark ski binding assembly of FIG. 7.

The telemark ski binding assembly 20 of the present disclosure has a toe retainer 22 and a lock assembly 24. The lock assembly has an actuator assembly 26. The lock assembly 24 is coupled to the toe retainer 22. An operator can adjust the lock assembly 24 from being in a first configuration, unlocked configuration (See FIGS. 1-3 showing lock assembly in the unlocked configuration), to being in a second configuration, locked configuration. See FIGS. 4-7 showing lock assembly in the locked configuration. The operator can also adjust the lock assembly from being in the second configuration to being in the first configuration. The toe retainer, when the lock assembly is in the first configuration, unlocked configuration, is itself unlocked and in a touring mode. Thus, placing the lock assembly in the unlocked configuration from the locked configuration unlocks the toe retainer. The toe retainer 22 when unlocked is unrestrained from rotating (pivoting) relative to a base 44. Thus, when an operator takes steps, the toe retainer rotates (pivots) relative to the base 44 along and with a first rotating radius. The first radius has a center point 28 which is a pivot point. The point is a center point and pivot of rotation of the toe retainer.

The toe retainer 22 when the lock assembly 24 is in the second configuration, locked configuration, is restrained from rotating (pivoting). The toe retainer is itself locked and in the ski mode. Thus, placing the lock assembly in the locked configuration from the unlocked configuration locks the toe retainer. (See FIGS. 4-7 showing the toe retainer locked). Preferably the toe retainer 22 when locked is restrained from rotating (pivoting) more than a negligible amount, relative to the base. Most preferably it is fully restrained from rotating (pivoting), relative to the base 44, when locked.

As explained in more detail below, an operator can adjust the lock assembly 24 to the locked configuration from the unlocked configuration by adjusting an actuator 30 of the actuation assembly 26 to a second position, down position 32, from a first position, up position 34. Adjusting the actuator 30 to the second position 32 places a latch 36 of the lock assembly 24 and a catch 38 of the lock assembly 24 into an interference position with respect to one another. See FIG. 4. When in the interference position, the latch 36 and catch 38 cooperate to restrain the toe retainer 22 from rotating (pivoting) relative to the base. Preferably the toe retainer is fully restrained from rotating (pivoting) relative to the base 44.

A heel retainer 40 is coupled to the toe retainer 22. A coil spring 42 biases the heel retainer 40 against rotating relative to the toe retainer 22. The bias restrains the heel retainer 40 from rotating, relative to the toe retainer 22, when the toe retainer is unlocked and can rotate (pivot) relative to the base 44. Thus, when the toe retainer 22 is unlocked, and an operator takes steps, the toe retainer 22 and heel retainer 40 will both rotate together in unison substantially inline along and with first rotating radius and around the first center point 28. The heel retainer remains substantially rotationally fixed in place relative to the toe retainer 22. On the other hand, when the toe retainer 22 is locked and is restrained from rotating (pivoting), the heel retainer 40 will rotate, relative to the toe retainer 22 and base 44. It will rotate with and along a rotating second radius around a second center point 46. The radius has the second center point 46 which is a second pivot point. The second center point 46 is a center point of rotation of the heel retainer. The second point 46 is at a different location than the first point 28. Thus, when the toe retainer 22 is locked, and an operator takes steps, the heel retainer 40 will rotate relative to the toe retainer 22 and the base 44 around the second center point 46 which is different from the first center point 28. The toe retainer is restrained from rotating (pivoting) relative to the base 44.

In more detail, the toe retainer 22 has an upper portion 22*a*, side portions 22*b*, 22*b*' and a bottom portion 22*c*, 22*c*'. The upper portion 22*a*, side portions 22*b*, 22*b*' and a portion 22*c*' of the bottom portion 22*c*, 22*c*' form a seamless toe cage 22*a*, 22*b*, 22*b*', 22*c*'. The bottom portion 22*c*, 22*c*' of the toe retainer, in addition to the portion 22*c*' forming the cage, includes a central bottom portion 22*c*. The bottom portion 22*c*' forming the cage laterally bounds the central bottom portion 22*c*. The side portions 22*b*, 22*b*' of the toe retainer include lateral boot supporting sections 22*b* and lateral coupling sections 22*b*'. The lateral boot supporting sections 22*b* provide lateral boot support. The lateral coupling sections 22*b*' seamlessly carry the catch 38 and receive a first coupling 48 which pivotally couples the toe retainer 22 to the base 44. The lateral coupling sections 22*b*' also receive a second coupling 50 which pivotally couples the toe retainer 22 to a knuckle 62 whose import is explained more fully below. The lateral coupling sections 22*b*' also receive a support 52 which resists movement of a portion of the coil spring 42 which is carried by the second coupling 50.

The following explains in more detail how the heel retainer 40 is coupled to the toe retainer 22 and biased by the coil spring 42. The heel retainer 40 is fixedly coupled to a rear case 54. The rear case 54 is slideably coupled to a pair of main tubes 56. The rear case slides over the tubes 56 in the first 58 and second 60 longitudinal directions when an operator telemark skis. The rear case 54 is coupled to a pair of compression springs (not shown) which bias the rear case 54 towards the first longitudinal direction 58. One compression spring is in each main tube 56. The pair of main tubes 56 are fixedly coupled to the knuckle 62. The second coupling 50 is received in the knuckle 62 and pivotally couples the knuckle 62 to the toe retainer 22 lateral sections 22*b*' and thus rotationally couples the heel retainer 40 to the toe retainer 22.

The coil spring 42 biases the knuckle 62 against rotating (pivoting) relative to the toe retainer 22. The bias restrains the knuckle 62 from rotating (pivoting), relative to the toe retainer 22, when the toe retainer 22 is unlocked and rotates (pivots) relative to the base. Thus, when the toe retainer 22 is unlocked, and an operator takes steps, the toe retainer 22, knuckle 62, main tubes 56, rear case 54, and heel retainer will all rotate together in unison, inline along and with the first radius around first center point 28. On the other hand, when the toe retainer 22 is locked and is restrained from pivoting relative to the base, the knuckle 62, main tubes 56, rear case 54, and heel retainer 40 will all rotate together in unison and inline along and with the second radius around the second center point 46, relative to the toe retainer and base. Thus, when the toe retainer is locked and therefore unable to pivot, and an operator takes steps, the knuckle 62, main tubes 56, rear case 54, and heel retainer 40 will all rotate together, in unison and inline along and with the second radius around the second center point 46, relative to the toe retainer and base.

The base 44 carries at least a portion of the lock assembly 24. The lock assembly 24 comprises the actuator assembly 26, the latch 36, and the catch 38. The actuator assembly 26, in addition to the actuator 30 comprises a linkage assembly 64 which couples the actuator 30 to the latch 36. The linkage assembly 64 includes a first pin 64*a* which is received by the actuator 30. The first pin 64*a* is coupled to the base 44 by a first link 64*b*. The first link 64*b* is rotatable relative to the first pin 64*a* and the base 44. The linkage assembly includes a second pin which is received by the actuator. The second pin 64*c* is slideably coupled to the base 44 through an elongated opening 65 in the base 44. The actuator 30 is coupled to the second pin 64*c*. The second pin 64*c* is coupled to a spring support 64*d* which carries a compression spring 64*e*. The compression spring 64*e* is between an end 64*d*' of the spring support and a first end 64*f* of a second link 64*f*. A second end 64*f*" of the second link 64*f* is coupled to the latch 36. An extension spring 64*g* couples the second link 64*f* to the base 44 and biases the second link 64*f* in a position which places the latch 36 outside of the catch 38 opening. The catch 38 and latch 36 are in a non-interfering position relative to one another when the latch is outside of the catch. In the non-interfering position, the toe retainer 22 is unlocked, and the lock assembly 24 is in the unlocked configuration.

To adjust the lock assembly 24 from the unlocked configuration to the locked configuration, the actuator 30 is moved from the up first position 34 to the down second position 32 by an operator. Before rotating the actuator 30 to the down position 32, the actuator 30 is first moved forward in the first longitudinal direction 58 carrying the second pin 64*c*, spring support 64*d*, compression spring 64*e*, second link 64*f* and latch 36 forward in the first longitudinal direction 58 against the bias of the extension spring 64*g*. The latch 36 and second link 64*f* are moved forward with the actuator 30 until the latch 36 contacts an abutment portion 38' of the catch 38. The contact prevents further movement of the latch 36 and second link 64*f* forward in the first direction 58. The actuator 30, however, can be further moved forward in the first longitudinal direction 58 and rotated down below center. The further movement and rotation below center carries the second pin 64*c* away from the second link 64*f* in the first longitudinal direction 58 and carries the spring support 64*d* through the second link first end 64*f* in the first longitudinal direction 58. The further forward movement and rotation compress the compression spring 64*e*. The lock assembly 24 and toe retainer 22 are locked after the further forward movement and rotation below center. Link 64*b* when rotated below center is at an angle 67 greater than 180 degrees with the base 44. To adjust the lock assembly 24 from the locked configuration to the unlocked configuration, the actuator 30 is moved from the down second position 32 to the up first position 34 by an operator. Rotation, of the actuator 30 up also moves the actuator rearward in the second longitudinal direction 60. After rotation upward, the extension spring 64*g* pulls the actuator further in the second longitudinal direction 60 carrying the second pin 64*c*, spring support 64*d*, compression spring 64*e*, second link 64*f* and latch 36 in the second longitudinal direction 60. The latch 36 and second link 64*f* are moved in the second direction 60 by the extension spring 64*g* until the latch 36 contacts an abutment portion 65' defining the elongated opening 65 of the base 44. The contact prevents further movement of the latch 36 and second link 64*f* in the second direction 60. The latch 36 is outside of the catch opening 38. The catch 38 and latch 36 are in a non-interfering position relative to one another. In the non-interfering position, the toe retainer 22 is unlocked, and the lock assembly 24 is in an unlocked configuration.

The base 44 carries a ski brake assembly. The brake assembly comprises a ski beak 66 and a coil spring 68. The ski brake 66 comprises brake wire 66*a* coupled to a brake mover 66*b*, and claws 66*c* coupled to the brake wire 66*a*. The coil spring 68 is carried by the brake wire and abuts up against a portion of the base 44. The ski brake 66 is adjustable between a braking position (ski brake down, see FIG. 4) and a ski position (ski brake up, see FIG. 5). The coil spring 68 biases the brake 66 in a braking position. In the braking position, the brake mover 66*b* is in an up position, see FIG. 4. In the up position, a portion of the brake mover 66*b* is further above the toe retainer bottom 22*c*, 22*c*' then when the ski brake 66 is in the skiing position. Also, the beak brake wire 66*a* and brake claws 66*c* extend further downward in a vertical position as compared to when the brake 66 is in the skiing position. The brake mover 66*b* has brake mover extensions 66*b*', which couple with toe retainer bottom extensions 22*e*. The bottom extensions 22*e* couple to the brake mover extensions 66*b*' when the toe retainer is rotated up relative to the base. The coupling moves the brake mover 66*b* down as the toe retainer is rotated up.

The heel retainer 40 comprises a bottom 40*a*, lateral side supports 40*b*, a clip 40*c*, and a clip lock 40*d*. The clip 40*c* is coupled to the lateral side supports 40*b* and spring loaded with a coil spring to be biased in an unclipped position, see FIG. 4. A heel of a boot pushes the clip 40*c* into a clipped position, see FIG. 5, when the boot is coupled to the binding. The clip lock 40*d* is placed in the locking position, see FIG. 5, to lock the clip 40*c* into the clipped position. In the locking position the clip lock upper 40*d*' is oriented to engage a clip upper 40*c*'.

As is evident from the foregoing description, certain aspects of the present invention are not limited to the details of the examples illustrated herein. It is therefore contemplated that other modifications and applications using other similar or related features or techniques will occur to those skilled in the art. It is accordingly intended that all such modifications, variations, and other uses and applications which do not depart from the spirit and scope of the present invention are deemed to be covered by the present invention. Other aspects, objects, and advantages of the present invention can be obtained from a study of the drawings, the disclosures, and the appended claims.

The invention claimed is:

1. A telemark ski binding assembly comprising:

a toe retainer;

a base, said toe retainer pivotally coupled to said base;

a lock assembly, said lock assembly has an actuator assembly; said lock assembly adjustable between a locked configuration and an unlocked configuration;

a heel retainer;

a knuckle pivotally coupled to said toe retainer;

a pair of main tubes fixedly coupled to said knuckle;

a rear case slideably coupled to said main tubes; wherein said heal heel retainer fixedly coupled to said rear case;

wherein when the lock assembly is in the unlocked configuration, said toe retainer is unlocked, said toe retainer and heel retainer both are rotatable together substantially inline, relative to the base, around a first center point; and wherein when the lock assembly is in the locked configuration, said toe retainer is locked, said toe retainer is restrained from rotating relative to the base, said heal retainer is rotatable relative to said toe retainer around a second center point, said second center point at a different location from said first center point.

2. The telemark ski binding assembly of claim 1 wherein the knuckle is biased against rotating about said pivotable coupling relative to said toe retainer.

3. The telemark ski binding system of claim 2, further comprising:

an actuator being part of said actuator assembly;

a latch and a catch being part of said lock assembly;

wherein adjusting the actuator to a second position from a first position adjusts the lock assembly to the locked configuration, said adjustment to said second position, places said latch of the lock assembly and said catch of the lock assembly into an interference position with respect to one another, and in the interference position the latch and catch cooperate to restrain the toe retainer from rotating relative to the base.

4. A telemark ski binding assembly comprising:

a toe retainer;

a base, said toe retainer pivotally coupled to said base;

a lock assembly, said lock assembly has an actuator assembly; said lock assembly adjustable between a locked configuration and an unlocked configuration;

a heel retainer, said heal retainer rotatably coupled to said toe retainer;

an actuator being part of said actuator assembly;

a latch and a catch being part of said lock assembly;

a knuckle pivotally coupled to said toe retainer;

a pair of main tubes fixedly coupled to said knuckle;

a rear case slideably coupled to said main tubes; wherein said heel retainer fixedly coupled to said rear case;

when the lock assembly is in the unlocked configuration, said toe retainer is unlocked, said toe retainer and heel retainer both are rotatable together substantially inline, relative to the base, around a first center point;

when the lock assembly is in the locked configuration, said toe retainer is locked, said toe retainer is restrained from rotating relative to the base, said heal retainer is rotatable relative to said toe retainer around a second center point, said second center point at a different location from said first center point;

the heel retainer is biased against rotating relative to said toe retainer; and adjusting the actuator to a second position from a first position adjusts the lock assembly to the locked configuration, said adjustment to said second position, places said latch of the lock assembly and said catch of the lock assembly into an interference position with respect to one another, and in the interference position the latch and catch cooperate to restrain the toe retainer from rotating relative to the base.

5. The telemark ski binding system of claim 4, wherein said heel retainer further comprises:

a bottom;

lateral side supports coupled to said bottom;

a clip coupled to said lateral side supports; and a clip lock coupled to said lateral side supports.

6. The telemark ski binding assembly of claim 4, wherein when the lock assembly is in the unlocked configuration and the toe retainer is unlocked, the toe retainer, knuckle, main tubes, rear case, and heel retainer are rotatable together, relative to the base, substantially inline around the first center point; and wherein when the lock assembly is in the locked configuration and the toe retainer is locked, the knuckle, main tubes, rear case, and heel retainer are rotatable together, relative to the toe retainer, substantially inline around the second center point.

7. The telemark ski binding assembly of claim 6 wherein the toe retainer further comprises:

side portions coupled to a bottom portion;

wherein the side portions comprise lateral support sections and lateral coupling sections; and wherein the lateral coupling sections seamlessly carry the catch and receive a first coupling which pivotally couples the toe retainer to the base; and wherein the lateral coupling sections also receive a second coupling which pivotally couples the toe retainer to the knuckle.

8. The telemark ski binding assembly of claim 7 wherein the actuator assembly further comprises:

a first pin which is received by the actuator;

a first link coupling the base to the first pin, said first link is rotatable relative to the first pin and the base;

a second pin which is received by the actuator, said second pin is slideably coupled to the base through an elongated opening in the base;

a spring support coupled to the second pin;

a compression spring carried by the spring support;

a second link coupled to said spring support;

an extension spring coupling the second link to the base and biasing the second link towards a position which places the latch outside of an opening of the catch.

9. The telemark ski binding assembly of claim 8 wherein:

when said actuator is in an up first position, said actuator is moveable in a first longitudinal direction, movement in said first direction carries the second pin, spring support, compression spring, second link and latch forward in the first longitudinal direction against the bias of the extension spring until the latch contacts an abutment portion of the catch, said contact prevents further movement of the latch and second link forward in the first direction with said actuator.

10. The telemark ski binding assembly of claim 9, wherein post contact, the actuator is further movable in the first longitudinal direction and rotatable down below center.

11. The telemark ski binding assembly of claim 10 wherein the further movement and rotation below center carries the second pin away from the second link in the first longitudinal direction and carries the spring support through a first end of the second link and compresses the compression spring.

12. A telemark ski binding assembly comprising:

a toe retainer;

a base, said toe retainer pivotally coupled to said base;

a lock assembly, said lock assembly has an actuator assembly; said lock assembly adjustable between a locked configuration and an unlocked configuration;

a heel retainer, said heel retainer rotatably coupled to said toe retainer;

an actuator being part of said actuator assembly;

a latch and a catch being part of said lock assembly, said catch having a surface delimiting a wedge shaped receptacle to receive said latch; wherein when the lock assembly is in the unlocked configuration, said toe retainer is unlocked, said toe retainer and heel retainer both are rotatable together substantially inline, relative to the base, around a first center point;

when the lock assembly is in the locked configuration, said toe retainer is locked, said toe retainer is restrained from rotating relative to the base, said heal retainer is rotatable relative to said toe retainer around a second center point, said second center point at a different location from said first center point;

adjusting the actuator to a second position from a first position adjusts the lock assembly to the locked configuration, said adjustment to said second position, places said latch of the lock assembly and said catch of the lock assembly into said interference position with respect to one another, in the interference position said latch extending into said wedge shaped receiver and in the interference position the latch and catch cooperate to restrain the toe retainer from rotating relative to the base.

13. A telemark ski binding assembly comprising:

a toe retainer;

a base, said toe retainer pivotally coupled to said base;

a lock assembly, said lock assembly has an actuator assembly; said lock assembly adjustable between a locked configuration and an unlocked configuration;

a heel retainer, said heal retainer rotatably coupled to said toe retainer;

an actuator being part of said actuator assembly;

a latch and a catch being part of said lock assembly; wherein when the lock assembly is in the unlocked configuration, said toe retainer is unlocked, said toe retainer and heel retainer both are rotatable together substantially inline, relative to the base, around a first center point;

wherein when the lock assembly is in the locked configuration, said toe retainer is locked, said toe retainer is restrained from rotating relative to the base, said heal retainer is rotatable relative to said toe retainer around a second center point, said second center point at a different location from said first center point;

adjusting the actuator to a second position from a first position adjusts the lock assembly to the locked configuration, said adjustment to said second position, places said latch of the lock assembly and said catch of the lock assembly into the interference position with respect to one another, and in the interference position the latch and catch cooperate to restrain the toe retainer from rotating relative to the base; and adjusting said actuator to said second position moves said actuator against an opposing force of increasing magnitude.

* * * * *